United States Patent [19]

Rymarchyk, Jr. et al.

[11] Patent Number: 4,494,737

[45] Date of Patent: Jan. 22, 1985

[54] LANCE FOR REPAIRING THE LINING OF STEELMAKING VESSELS

[75] Inventors: Nicholas M. Rymarchyk, Jr., Wexford; Leo L. Meinert, Baden, both of Pa.

[73] Assignee: Pullman Berry Company, Harmony, Pa.

[21] Appl. No.: 546,631

[22] Filed: Oct. 27, 1983

Related U.S. Application Data

[63] Continuation of Ser. No. 309,644, Oct. 8, 1981, abandoned.

[51] Int. Cl.[3] ..... C21B 7/04

[52] U.S. Cl. ..... 266/281; 239/132.3; 239/186; 239/227; 239/264; 239/391; 118/317; 118/323

[58] Field of Search ..... 266/44, 281; 239/132.1, 239/132.3, 186, 187, 225, 246, 247, 248, 249, 264, 265, 227, 391; 118/306, 317, 323; 264/30

[56] References Cited

U.S. PATENT DOCUMENTS

| | | | |
|---|---|---|---|
| 3,351,289 | 11/1967 | Demaison | 239/132.3 |
| 3,827,633 | 8/1974 | Kouno et al. | 239/132.3 |
| 3,917,170 | 11/1975 | Marino | 239/132.3 |
| 4,270,949 | 6/1981 | Esposito et al. | 75/60 |
| 4,272,018 | 6/1981 | Hickson | 239/8 |
| 4,272,020 | 6/1981 | Allison | 239/8 |

FOREIGN PATENT DOCUMENTS

| | | | |
|---|---|---|---|
| 333196 | 7/1972 | U.S.S.R. | 266/281 |

*Primary Examiner*—M. J. Andrews
*Assistant Examiner*—Robert L. McDowell
*Attorney, Agent, or Firm*—Richard J. Myers

[57] ABSTRACT

A water-cooled lance is supported above the mouth of a steel-making vessel for vertical reciprocating movement and includes a slurry pipe which is rotatably positioned to spray repair material against the inner lining of the vessel, or to place a new lining on the interior of the vessel.

25 Claims, 18 Drawing Figures

LANCE FOR REPAIRING THE LINING OF STEELMAKING VESSELS

This application is a continuation of application Ser. No. 309,644 filed Oct. 8, 1981, now abandoned.

BACKGROUND OF THE INVENTION

1. Field of the Invention

The field of invention relates to steelmaking furnaces and particularly to apparatus for repairing the inner refractory lining of furnaces, ladles or vessels utilized in the process. More specifically the invention relates to a lance for repairing the lining of a Basic Oxygen Furnace, or any other vessel or ladle, and which is adapted to repair the furnace while the lance is supported in an upright position within the furnace, or supported in any position wherein the lance is positioned centrally, or at an angle to, the longitudinal axis of the furnace vessel laddles, or other.

2. Description of the Prior Art

In the prior art vessels or furnaces used in the steelmaking processes periodically require repair of the inner refractory lining because of the extreme temperatures, chemical reactions, and/or erosion and corrosion wear taking place within the furnace which break down the refractory lining at particular locations, and/or over the complete surface area. In the prior art most of the repair apparatus for repairing the inner linings are of the type which are carried on vehicles or carriages containing pipes generally called "slurry guns" which are inserted through the mouth of the vessel when it has been tilted on its side adjacent to the platform on which the carriage is rollingly supported. Slurry guns of this type are manipulated by the operator who stands a distance away from the carriage and gun and through various mechanical means and other remote operating devices manually directs the operation of the gun in connection with its shooting of the "slurry" material against the inner lining of the vessel which needs repair. Patents disclosing this type of operation are U.S. Pat. No. 3,351,289, issued Nov. 7, 1967, U.S. Pat. No. 3,87,633, issued Aug. 6, 1974, and U.S. Pat. No. 3,917,170, issued Nov. 4, 1975. The present invention is an improvement over the aforementioned patents in that it discloses a new and improved apparatus and process for repairing the inner linings of steel-making vessels which include a novel lance design which can be vertically or otherwise positioned and movable within the interior of the vessel and which can oscillate or circulate with respect to the furnace lining facilitating the repair thereof.

SUMMARY OF THE INVENTION

In the present invention the steel-making vessel or furnace is repaired while it is in its upright operating position. In this position a water-cooled or non-water-cooled slurry spray lance is connected to a hoist arrangement where upon the lance may be adjusted vertically and moved downwardly through the open mouth of the upright B.O.F. vessel. The lance is of a non-water-cooled type or a water-cooled type having inlet and outlet passages surrounding a central slurry pipe, which is provided at its lower end with a nozzle adapted to discharge "slurry" against the refractory lining of the vessel in need of repair. The repair lance disclosed may be readily disassembled and repaired itself as desired and includes a central swivel chamber within which the slurry pipe is disposed in rotatable manner. Upper and lower bearings positioned within the chamber of the lance support the slurry pipe for rotation. The upper end of the pipe is connected by means of a slurry pipe extension to a swiveling connection, in turn connected to a slurry tube and flexible hose for pumping, under required pressures, slurry through the slurry tube and outwardly through the nozzle for the repair of the inner lining of the vessel. The slurry tube includes threaded couplings which provide for ready disassembly of the slurry pipe when required. The water passages for inlet and outlet water are formed of concentric pipes certain of which support the upper and lower bearings and which are disposed to permit vertical load contraction and expansion due to the thermal load to which the lance may be subjected. While the lance is stationary the desired apparatus and process indicated herein includes mechanical or other means for oscillating or circulating the slurry pipe within any range required for a given operation thereby in turn oscillating or circulating the discharge orifices and the stream of slurry which is directed outwardly against the vessel lining. The oscillation of the slurry pipe is effected by hydraulic, air, electric or other means whereby during the operation the nozzle is constantly in movement for effectively spraying the repair material against the inner lining of furnaces or vessels.

Figure 9:
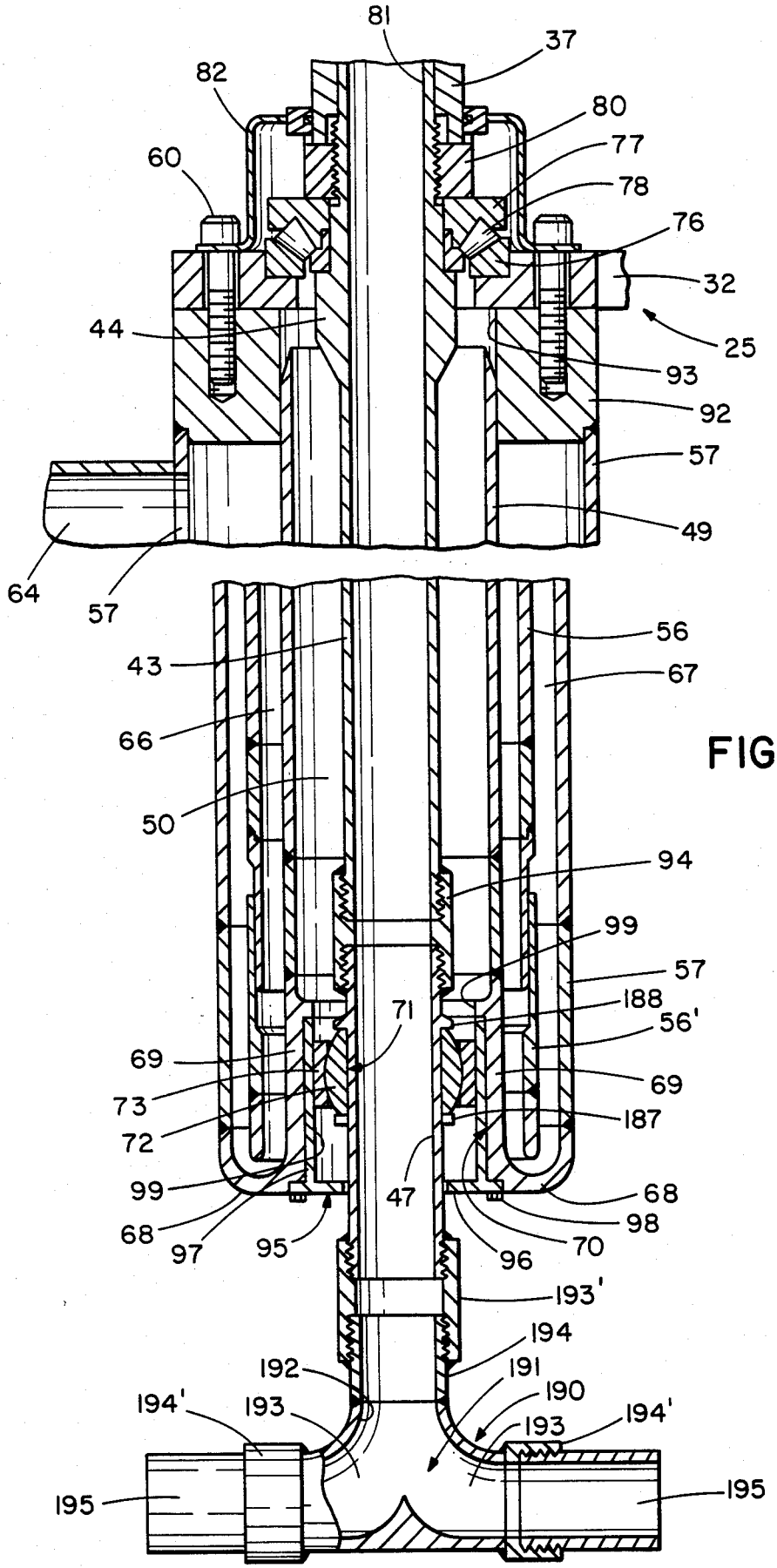
FIG. 9 is an enlarged view showing the upper and lower portions of the modified lance disclosed in FIG. 7 and 8.
Figure 13:
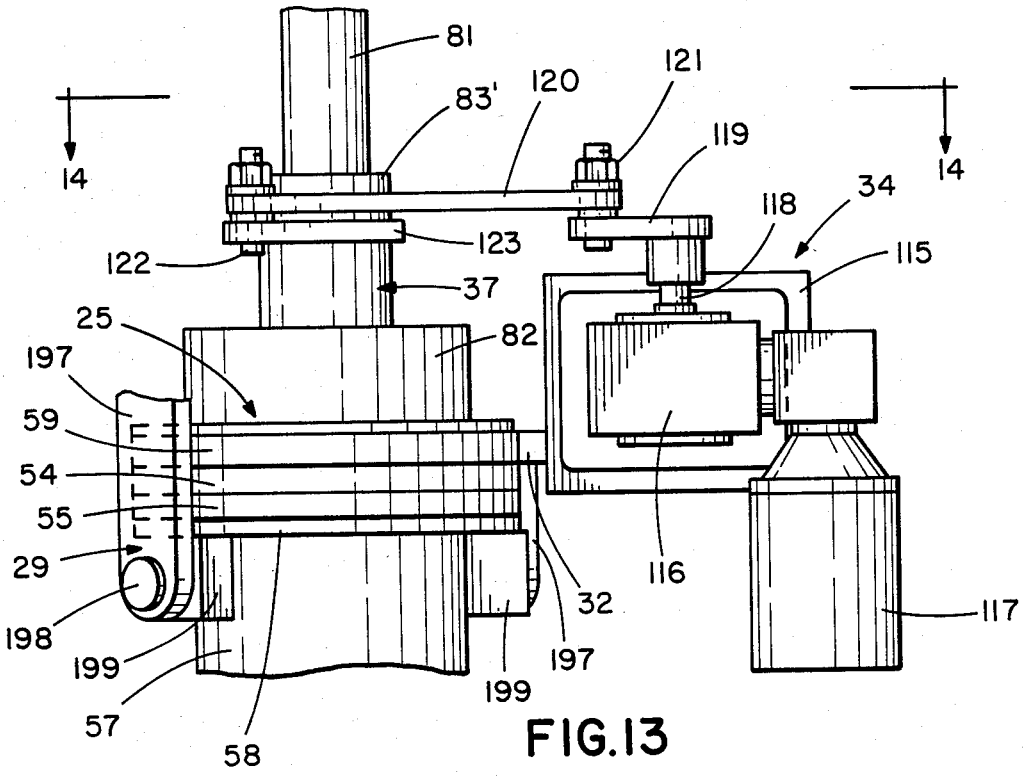
Figure 14:
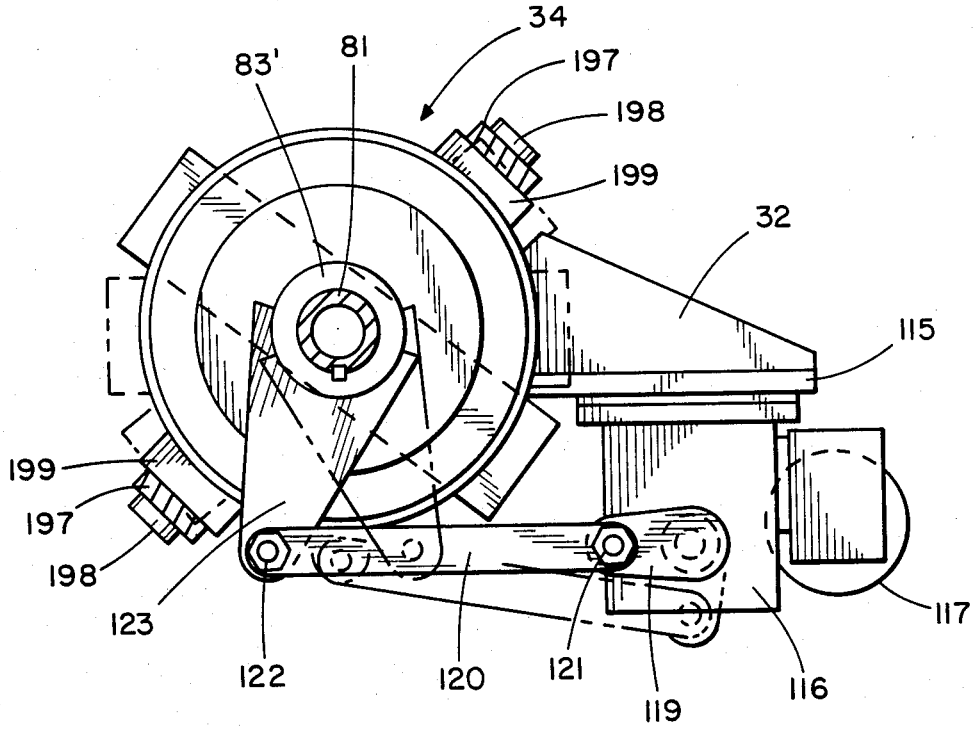
Figure 15:
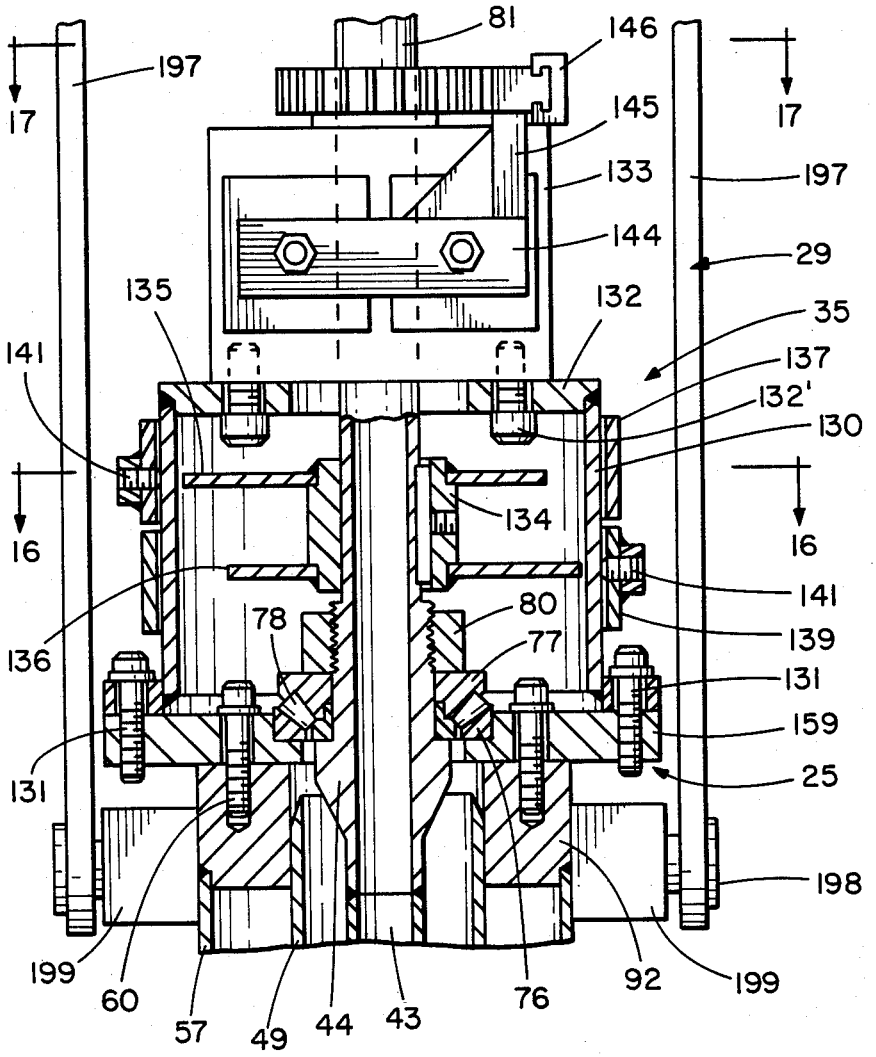
Figure 16:
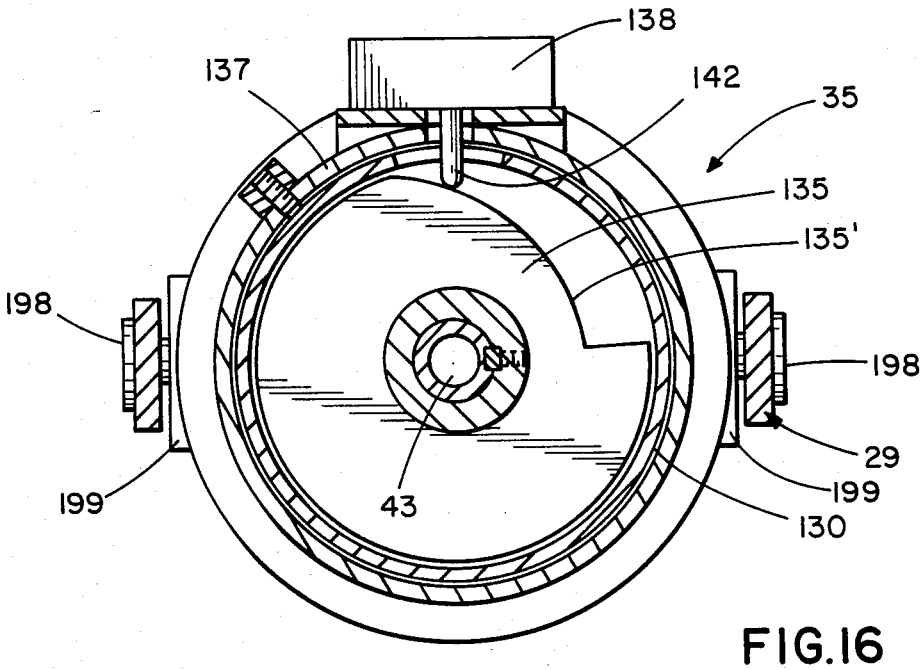

FIG. **12*a*** is still another modified nozzle arrangement;

FIG. 13 is a side elevational view of the upper portion of a repair lance disclosing another modified motor means for rotating the lance;

FIG. 14 is a sectional view taken substantially along the line 14—14 of FIG. 13;

FIG. 15 discloses the cross-section through the upper portion of a lance of the type shown in FIG. 9 disclosing another type of motor means of effecting rotation of the lance;

FIG. 16 is a cross-sectional view taken along the line 16—16 of FIG. 15; and

Figure 17:
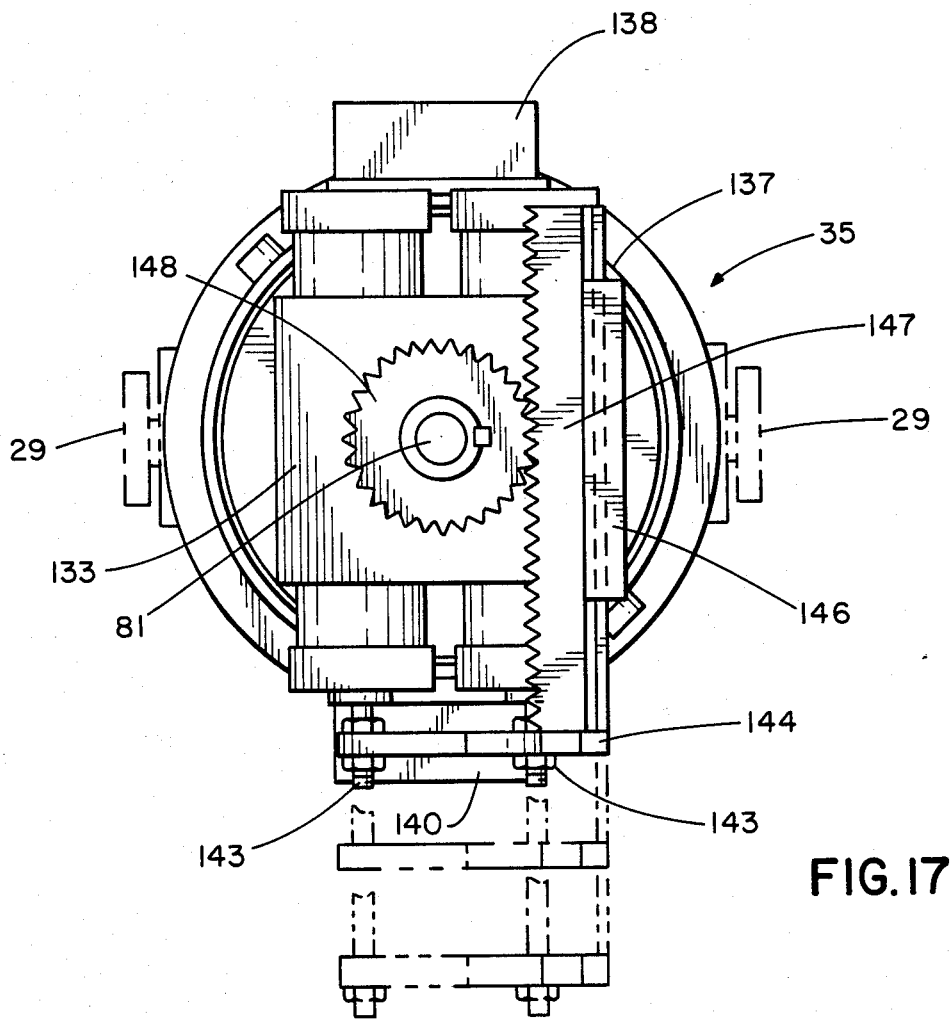

FIG. 17 is a cross-sectional view taken along the line 17—17 of FIG. 15.

DESCRIPTION OF THE PREFERRED EMBODIMENT

Referring particularly to FIGS. 1 through 4 a steel-making furnace arrangement which may be of the basic oxygen type, is designated by the reference character 10 and includes a vessel or furnace 11 having a raised superstructure 12 on which a platform 13 is supported. The platform 13 comprises an opening 14 within which the lower portion of the vessel 11 is supported and which may be moved to a tilted charging or tapping position. The vessel 11 includes an outer steel shell 15 having an outer inner lining and an inner lining 17 which may generally comprise a ceramic or refractory material having high heat resistant properties. The vessel 11 includes a charging opening 17' and is supported on trunnion supports 18 by means of trunnion 19 on the vessel 11. The arrangement 10 includes an exhaust stack or hood 20 having therein a lance access opening 21 positioned above the vessel 11.

A lining repair lance 23 comprises a pipe assembly 24 having a top adapter 25, a disconnect flange structure 26, and includes a water inlet pipe generally indicated at 27. Water is discharged from the lance through a water outlet pipe generally designated at 28, and thereupon to a water recycling system not shown.

The lance 23 is supported in a vertical position by means of a support arrangement generally designated at 29. The arrangement 29 includes a bracket structure 160 which may be suitably supported from a structure (not shown) housing the steel making operation. The bracket 160 includes upper and lower pivot supports 161 and 162 to which are respectively connected hinge brackets 163 and 164. A vertical rack and guide structure 165 is connected to the hinge bracket 163 and 164 and is adapted for hinging movement on the pivot supports 161 and 162. The structure 165 is provided at its upper end with a winch mechanism 166 which operates a cable 167 having an anchoring end 168 connected to the structure 165 as indicated at 168 in FIG. 1, its other end being trained about a winch pulley 169. The cable 167 is trained about a hoist pulley 170 carried by a guide carriage 171. The carriage 171 includes guide wheels 172 which are held captive and guided for vertical movement on the rack structure 165. The structure 165 thus provides for vertical and pivotal adjustment of the lance assembly 23. Upper and lower brackets 173 and 174, as shown only in FIG. 1, are connected to the guide carriage 171 and are rigidly secured to the lance 23 for supporting the same.

Figure 1:
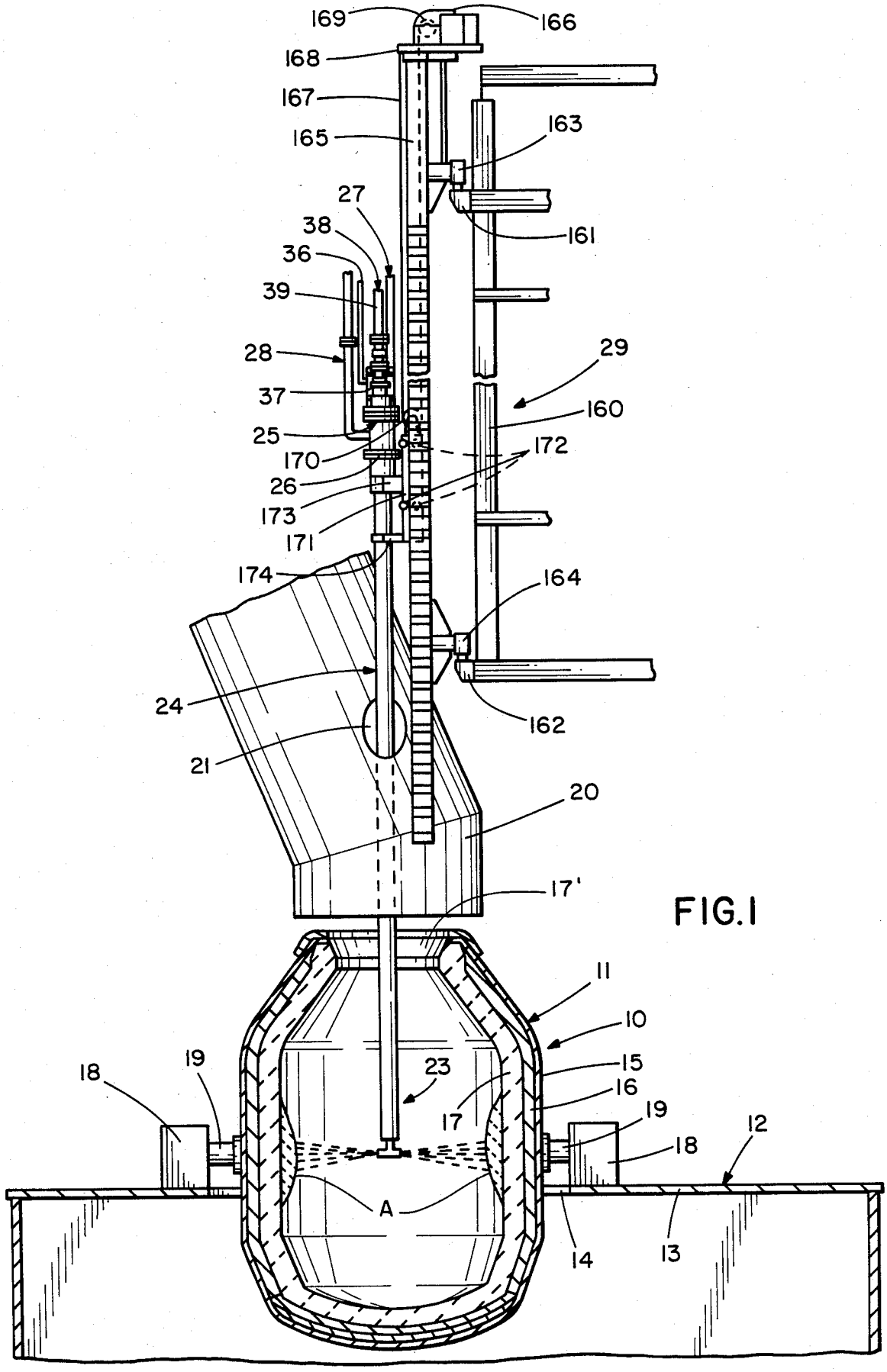
FIG. 1 is a side elevational view of the improved repair lance supported for vertical movement and in position within a steel-making vessel shown in section.

As indicated in FIG. 1, the repair lance 23 extends through the opening 21 down through the mouth 17' of the vessel 11. As best shown in FIGS. 1-4 a motor support 32 is connected to the top adapter 25 and includes a rotating motor unit 33. The motor unit 33 is operated by air, hydraulic fluid, electricity, or other means and FIG. 1 discloses a hose 36 which also may include a suitable wiring harness if required for the operation of the motor unit.

Figure 2:
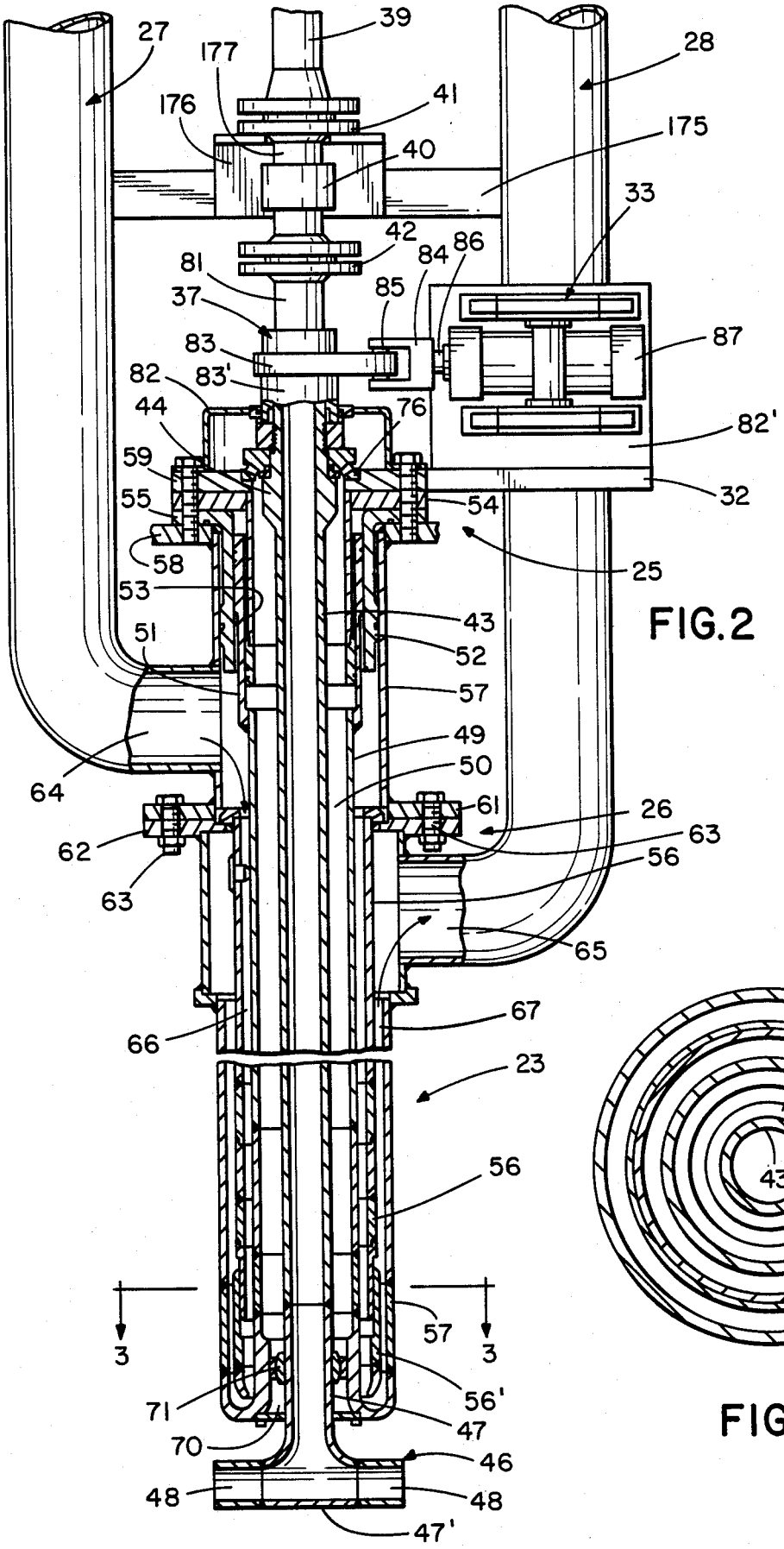
FIG. 2 is a cross-sectional view of the repair lance shown in FIG. 1.
Figure 3:
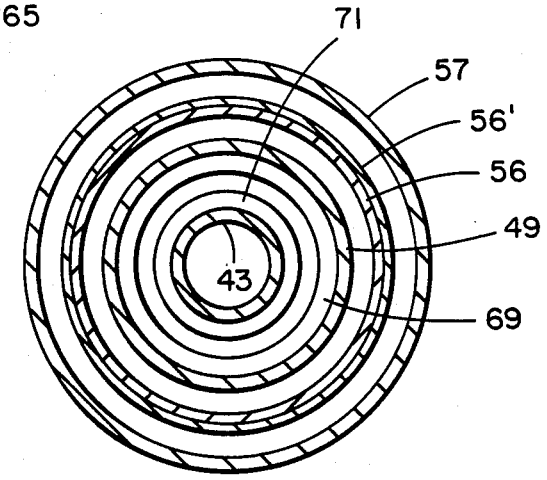
FIG. 3 is a cross-sectional view taken along the line 3—3 of FIG. 2.
Figure 4:
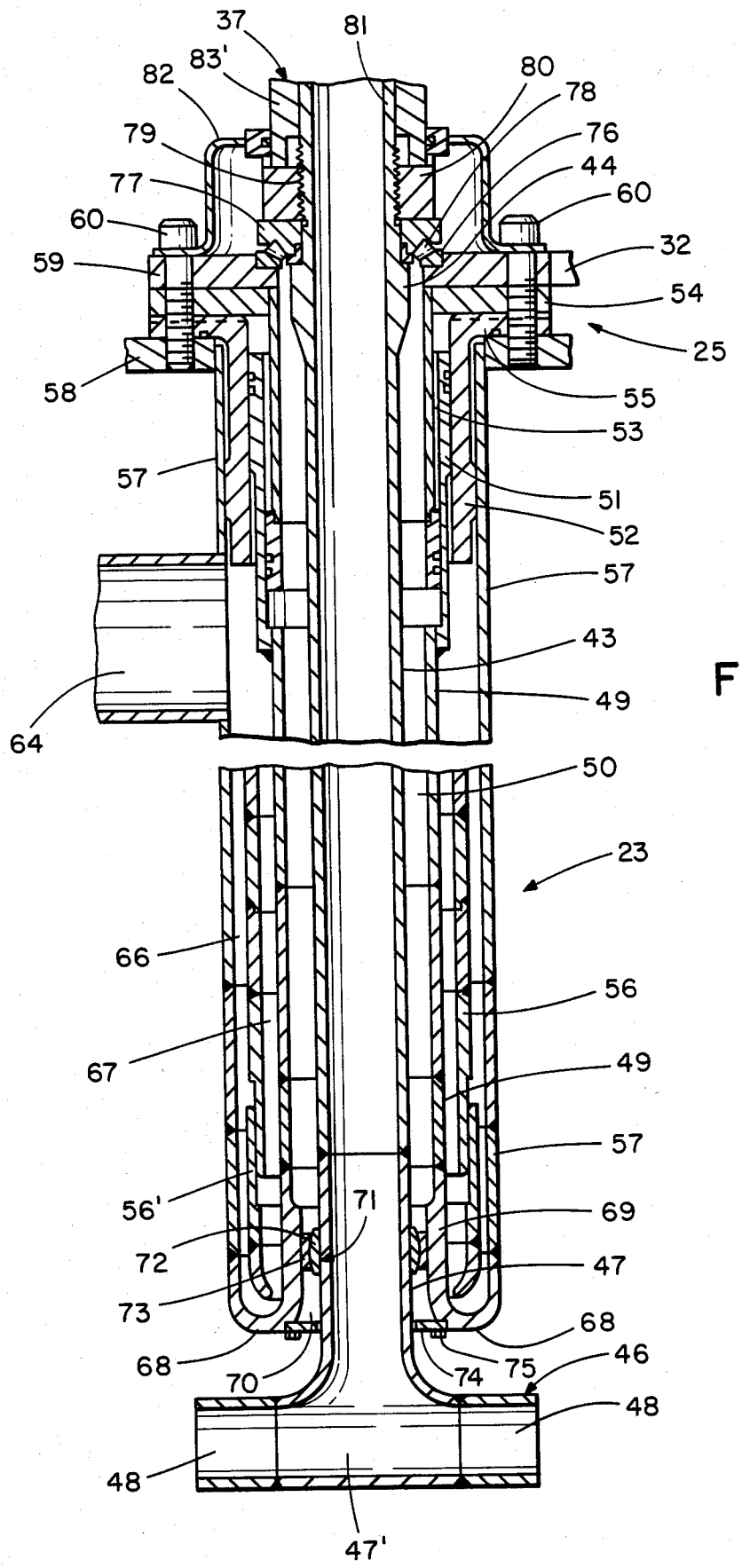
FIG. 4 is an enlarged cross-sectional view of the lance shown in FIG. 1 disclosing the upper and lower portions of the repair lance.

As shown in FIGS. 1 and 4 projecting upwardly from the top adapter 25 is a sleeve assembly 37. A slurry source in FIG. 1 is generally designated at 38 and includes a flexible slurry pipe 39 connected to the upper end of a swivel assembly 40 connectors on opposite sides of the swivel assembly 40 being designated at 41 and 42. A bracket 175 is supported on the water inlet and outlet arrangements or pipes 27 and 28. A flanged bracket 176 cradles a stub pipe 177 leading from the swivel assembly 40 to support the same. Referring now particularly to FIGS. 2, 3, and 4, the lance 23 includes a central slurry pipe 43 having at its upper end a pipe extension 44. The lower end of the slurry pipe is in communication and is connected to a discharge nozzle 46 of T-shaped configuration. The nozzle 46 includes a pipe section 47 connected to the lower end of the slurry pipe 43 by welding and is provided with a laterally extending branch pipe portion 47' provided at opposite ends with discharge orifices 48.

The lance 23 includes a pipe assembly comprising a first inner pipe 49 about which is provided a swivel chamber 50. The upper end of the first inner pipe 49 is connected to a piston sleeve 51 which in turn is in sliding relation with respect to a bushing 52 and an upper pipe stub extension 53 concentric with the inner pipe 49. Effectively, the pipe stub 53 and inner first pipe 49 cooperate as a single pipe, the piston sleeve and bushing arrangement providing for the vertical thermal expansion and contraction to which the pipe 49 is subjected. The inner pipe stub 53 includes at its upper end a flange 54 which is part of the adapter assembly 25. The bushing 52 also is provided at its upper end with a flange 55 bolted against the flange 54. A second intermediate pipe 56 is provided as best shown in FIG. 4 at its lower end with a stub extension 56' forming a continuation of the pipe 56 but permitting the vertical expansion and contraction due to heat. A third outer pipe 57 is provided at its upper end with a flange 58. A top plate 59 is connected together with the flanges 53, 54 and 58 by means of cap screws 60. A lower flange disconnect assembly is designated by the upper flange 61 which is connected to an upper portion of the third outer pipe 57. A lower flange 62 is connected to the second intermediate pipe 56 and the flanges 61 and 62 are suitably connected together by means of bolts and nuts 63. The arrangement is such as shown in FIG. 2 that a water inlet connection 64 directs water inwardly into a water inlet passage 66. The inlet passage 66 in turn conducts the cooling water thru the tip and to a water outlet passage 67 formed by the intermediate pipes 56 and the outer pipe 57.

As shown in FIG. 4 the pipes 49 and 57 are connected at their lower ends by arcuate connector walls 68 extending in circumferential fashion. The lower end of the inner pipe 49 is also provided with an enlarged thickness section 69. The positioning of the slurry pipe 43 relative to the pipe 49 provides for the swivel chamber 50 which is provided with an opening 70 at its lower end. The slurry pipe 43 is rotatably mounted within the lower end of the swivel chamber 50 by means of a semi-spherical bearing generally designated at 71. The bearing 71 includes a bearing portion 72 securely mounted on the lower end of the slurry tube 43 and a complemental bearing 73 which is rigidly mounted within the chamber 50 on the enlarged thickness section 69. A bottom plate 74 is secured to cover the opening 70 by means of cap screws 75. The bottom plate 74 is suitably apertured to provide for the extension of the pipe section 47.

Referring particularly to FIG. 4 the upper end of the slurry pipe 43 includes the pipe extension 44 which projects upwardly through the plate 59. A bearing race 76 is suitably supported on and partially recessed within the plate 59, and a complemental bearing race 77 on the pipe extension 44 cooperates with roller bearings 78 to provide for the swiveling of the upper end of the slurry tube 43. The extension 44 also includes a threaded portion 79 immediately above the bearing race 77 to which is attached a locking nut block 80. The extension 44 further includes an upper portion 81 which, as best shown in FIG. 2, extends into the connector 42 which in turn is rotatably connected to the swivel 40, in turn connected to the connector 41 and slurry tube 39. Swivel connectors 40 and 42 are conventional in the art providing a sealed swiveling connection between communicating pipes. A suitable cover 82 is positioned over the bearing arrangement and is locked in position by means of the cap screws 60, the cover 82 also including an opening for the sleeve and spacer assembly 37 which is seated upon the nut block 80.

Figure 5:
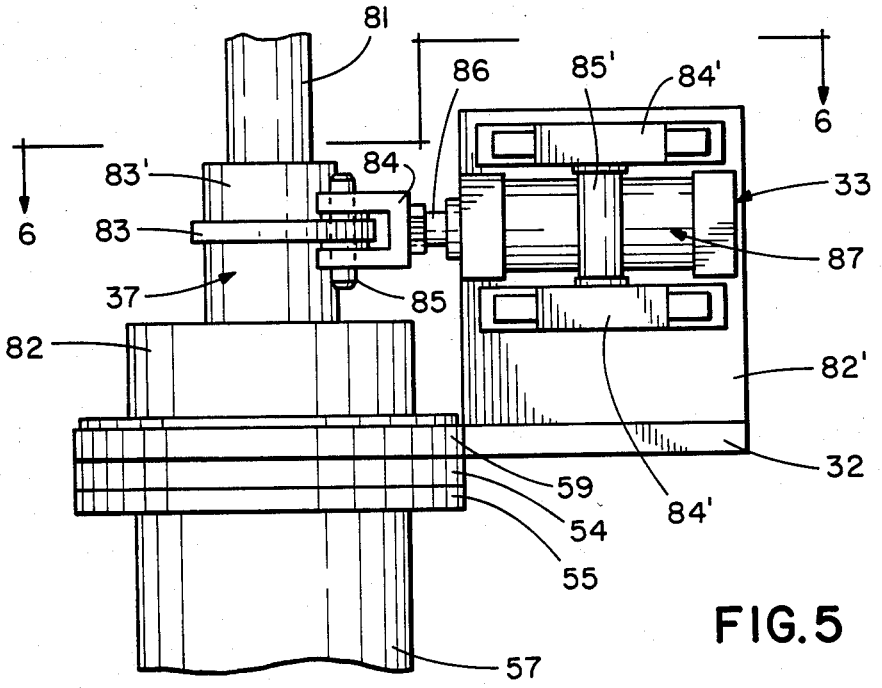
FIG. 5 is an enlarged side elevational view of the upper portion of a repair lance including an air motor means for rotating the same.
Figure 6:
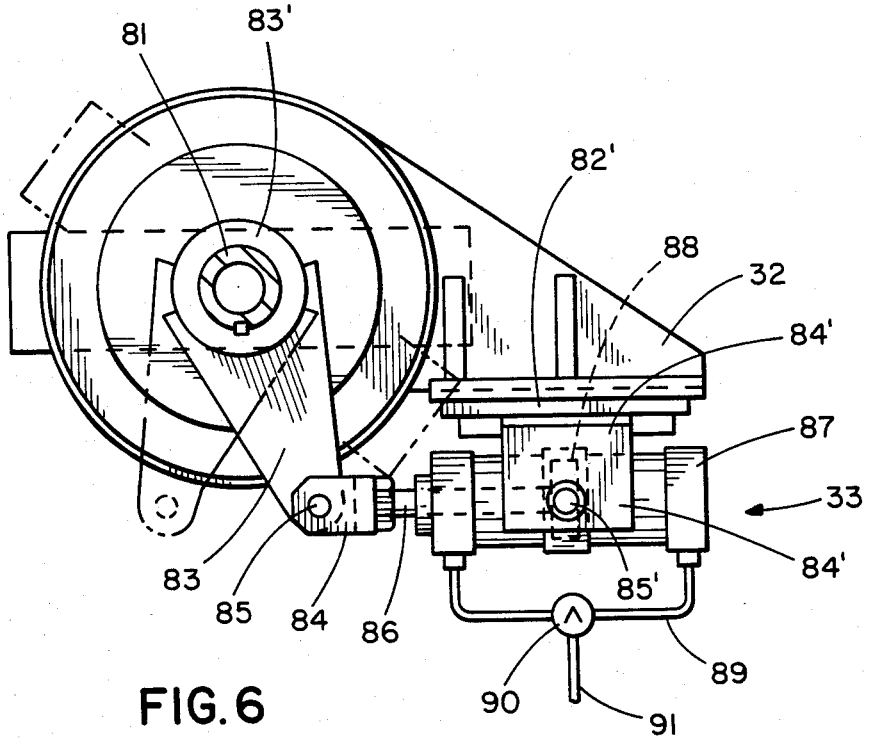
FIG. 6 is a cross-sectional view taken substantially along the line 6—6 of FIG. 5.

The slurry pipe 43 and its connected structure including the lower discharge nozzle 46 are rotated about the bearings and about the swivel connection 40 by means of a motor unit 33. FIGS. 5 and 6 disclose the motor unit 33 which is adapted to be utilized with the lance designs of FIGS. 2 and 4 and FIGS. 7 and 9. FIG. 5 discloses the motor 33 applied to the lance disclosed in FIGS. 2 and 4. As best shown in FIGS. 5 and 6 a collar 83' is provided on an arm 83 and is keyed to the upper section 81 of pipe extension 44 whereby rotation of the arm 83 pivots the slurry pipe 43. The arm 83 is pivotally connected to a yoke 84 by means of a pivot pin 85 the said yoke being in turn connected to a piston rod 86 extending into a cylinder designated at 87. The cylinder 87 is a fluid extensible type of device which may be operated by air, hydraulic fluid, or other fluid means. As best shown in FIG. 6 the piston rod 86 is reciprocable with a piston 88 actuated by the fluid pressure in lines 89. A valve 90 connects the hydraulic lines 89 and in turn is connected to a supply line 91. The valve 90 may be of a type which is controlled electrically to alternately supply fluid to the lines 89 for reciprocating the piston within the cylinder 87. Devices of this type are commercially available and need not further be described. The cylinder 87 is suitably supported on a vertical plate 82', in turn connected to the horizontal plate 32. Pivot plates 84' are connected to the vertical plate 82' and project outwardly with respect thereto. A pivot assembly 85' secures the cylinder 87 between the pivot plates 84' so that the same may oscillate in response to the oscillating action imparted to the arm 83 by means of the reciprocating piston rod 86.

THE OPERATION OF EMBODIMENT SHOWN IN FIGS. 1–6

In FIG. 1 a steel-making furnace vessel is mounted in a vertical position on the trunnions 19 and trunnions support 18. This is the normal position for steelmaking and in this connection oxygen blowing lances are utilized. In the position shown in FIG. 1 the vessel is in a repair position in that the lining adjacent to the trunnions 19 is in need of repair and replacement. It has been found that the inner lining most frequently is destroyed and needs repair in the region of the trunnions and the present lance design is particularly adapted to achieve this result. The lance 23 has been adjusted vertically by means of the carriage 171 to a position where the spray of the nozzle builds up material indicated by the letter A by two laterally extending streams emanating from opposite ends of the nozzle. The slurry to achieve this is supplied from the source 38 through the conduit 39, the swiveling connection 40, extension 44, and the slurry pipe 43 to the nozzle 47'. Simultaneously, with the repair operation, the lance continues to be cooled by the cooling passages receiving water from the inlet 64 and pipe 27. The cooling water is discharged through the connection 65 and returns through the pipe 28 to the recycling apparatus. Heat from within the vessel does not damage the repair lance since it is cooled and constructed for vertical expansion by means of the slip joints sleeves 56' and piston sleeve 51 and bushing sleeve 52. During the spraying operation, the entire nozzle 46 and slurry pipe 43 are oscillated or rotated by means of the motor arrangement 33. The slurry pipe 43 is free to oscillate on the bearing 71, bearing portions 76, 77 and rollers 78. As shown in FIG. 5 and 6, as the arm 83 is moved back and forth with response to movement of the piston 88, the slurry pipe 43 and nozzle 47 are moved in oscillating fashion thereby evenly distributing the desired slurry material on the desired area of the interior lining of the vessel. Vertical adjustment of the lance is predetermined or controlled by observation and operation of hoist or others and predetermined dimensions assure the exact repair at the exact spot where desired, since a predetermined selection provides for accurate achievement of the final result. Thus, the operator who controls the rack and guide structure 165 and winch structure 166 which lowers the repair lance into repair position can judge the vertical dimension required to achieve the selective distribution of ceramic slurry at the lining near the trunnion assemblies or other areas as shown in FIG. 1, or wherever else repair is required. The oscillating sweep of the nozzle spray is predetermined to provide for the sufficient coverage to effectuate repair within the furnace.

DESCRIPTION OF THE MODIFIED EMBODIMENT

Figure 7:
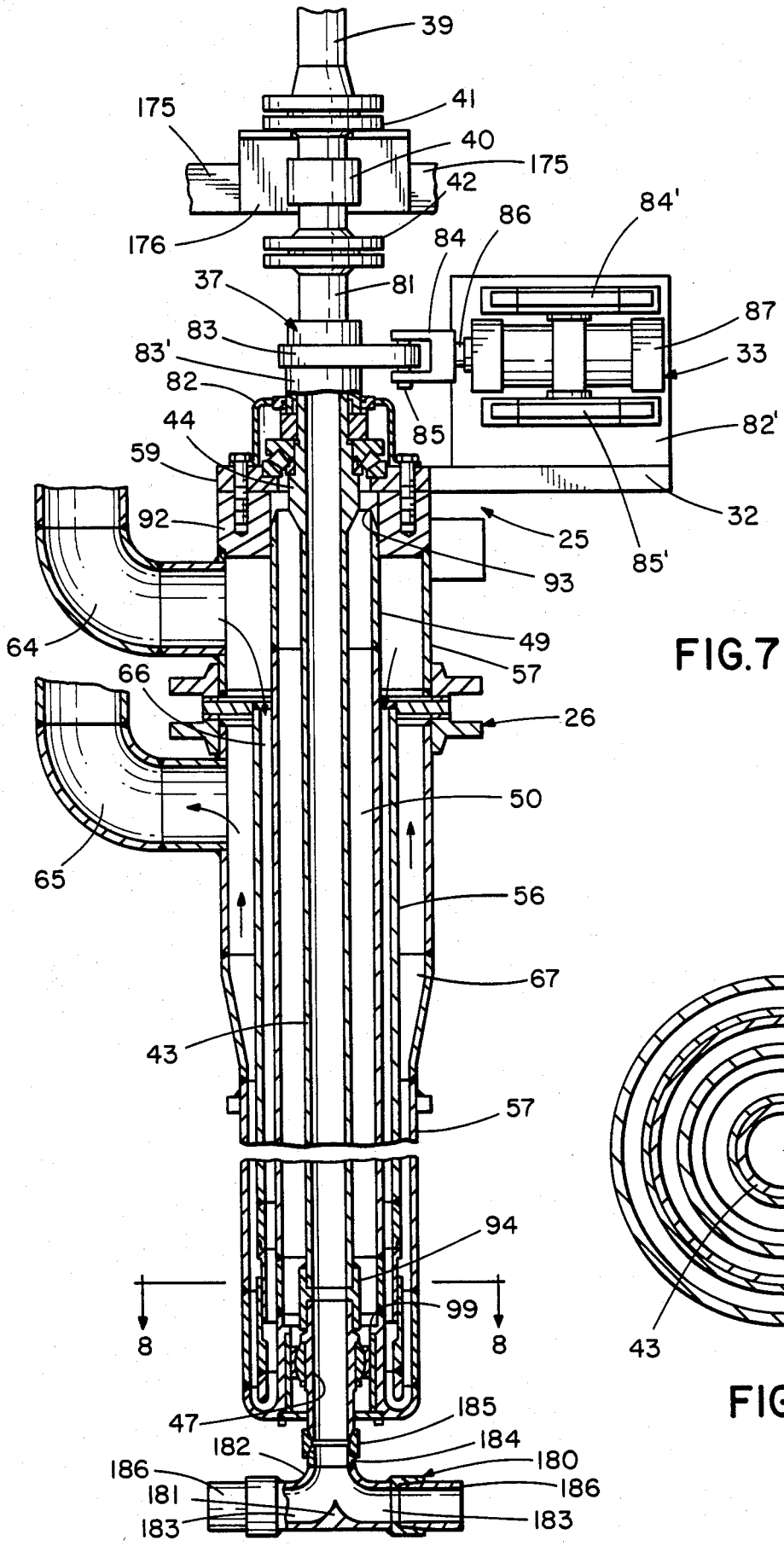
FIG. 7 is a side elevational view of a repair lance similar to a lance shown in FIGS. 1–6 disclosing certain modifications in the upper and lower portions of the lance.
Figure 8:
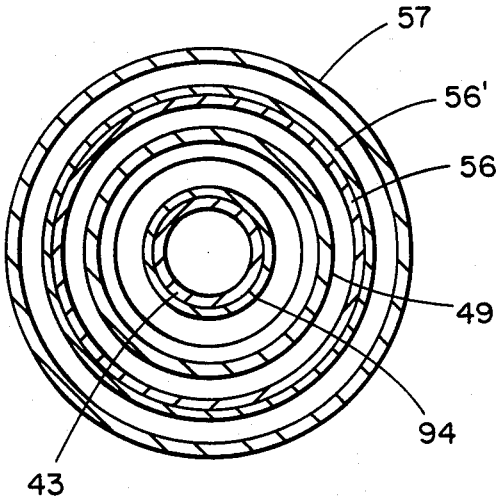
FIG. 8 is a cross-sectional view taken along the line 8—8 of FIG. 7.

FIGS. 7, 8 and 9 disclose another lance which is similar to the preferred embodiment having certain modifications. Where the parts are the same or similar the same reference characters will apply. The lance of FIGS. 7 and 9 also includes a modified adapter 25 which comprises a single annular plate 92 having an upper opening 93. The lower portion of the slurry pipe 43 includes a sleeve or coupling connector 94 which connects the lower end of the slurry pipe 43 to a T-shaped discharge nozzle 180. The discharge nozzle 180 includes a body 181 having a T-shaped conduit 182 and outlets 183. The T-shaped conduit 182 has a tubular stub 184 welded thereto which by means of a sleeve 185 is welded to the lower end of the slurry pipe section 47. Sleeves 180 are welded to outlets 183. Tubular extensions 186 are threaded to the sleeves 180. The threaded connections permit prompt and effecient repair of replacement of the individual components. Referring to FIG. 9, the opening 70 in the lower end of the swivel chamber 50 is closed by means of a cap 95 having an integral lower flat closure plate 96 and an upwardly extending tubular portion 97. Cap screws 98 removably support in closed position the cap 95 within an undercut 99 in the enlarged thickness section 69 of the inner pipe 49. As best shown in FIG. 9, the bearing 71 is positioned within the chamber 50 and includes the semi-spherical bearing portion 72 mounted on the pipe section 47 and the complemental bearing portion 73 which is supported on the inner circumferential surface of the tubular portion 97. Vertically spaced annular projections 187 and 188 provide support for the bearing portion 72.

The operation of the lance disclosed in FIG. 7, 8 and 9 is identical to the preferred embodiment in the spraying of the slurry in the desired manner. In this case a similar motor unit 33 may be provided, or modification motors 34 and 35 may also be utilized as desired.

In FIG. 7 the pipe 47 is connected to the pipe 43 by means of a connector 94 having opposite ends welded to ends of said pipes. In FIG. 9, the lance is slightly modified in that the connector 94 is threaded to the lower end of pipe 43 and is also threaded to the upper end of pipe 47. This again will permit ready and efficient replacement of the discharge nozzle.

In FIG. 9, an additional modification includes a nozzle 190. The nozzle 190 comprises a T-shaped body 191 having a T-outlet 192 and lateral outlets 193. A pipe section 194 is welded to the T-outlet 192 and is threaded to a threaded sleeve 193'. The sleeve 193' is in turn threaded to the lower projecting end of pipe section 47. Threaded connectors 194' are welded to the lateral outlets 193 and these in turn are in threaded engagement with tubular nozzle extensions 195.

Thus it is apparent that the lower end of the lance may be disassembled by removing the pipe 47 from engagement with the connector 94. Removal of the screws 98 permits the entire bearing assembly 71, pipe section 47 and nozzle 46 to be readily removed for replacement purposes. Similarly, the upper section 44 may be removed from the intermediate section of slurry pipe 43 and replaced as desired. Thus the arrangement is such that the lances may be quickly repaired and parts removed and replaced.

Figure 10:
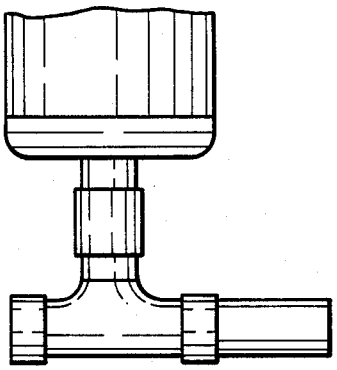
FIG. 10 shows the lower portion of a lance similar to that shown in FIG. 9 disclosing in elevation, a modified slurry nozzle.
Figure 11:
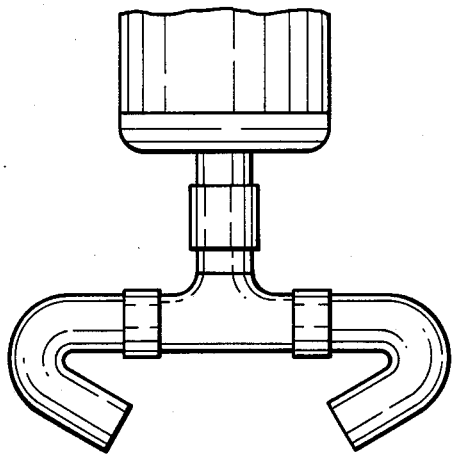
FIG. 11 is a view similar to FIG. 10 disclosing in elevation, another modified nozzle arrangement.
Figure 12:
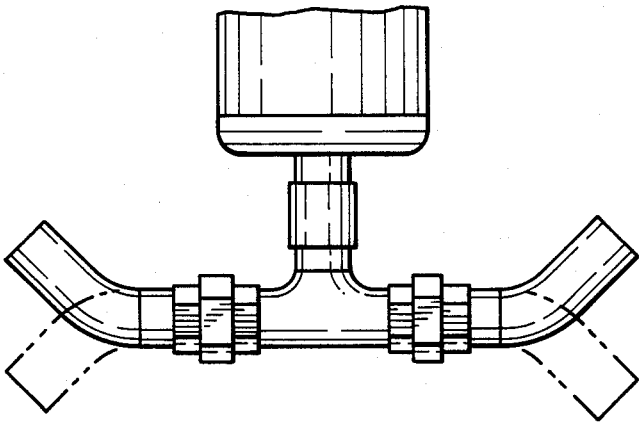
FIG. 12 is a further modified nozzle arrangement.

The method believed to be novel in the present invention is the process described above as shown in the drawings. The steps comprise the positioning of the vessel in an upright relation, inserting a lance through the upper open end of the vessel and supporting the same for relative vertical movement. The further steps include the pumping of a lining slurry material through the pipe and spraying the same laterally outwardly of the nozzle against the lining of the vessel. The step of rotating and oscillating the nozzle also is included in the process described. Vertical adjustment of the nozzle continues while the oscillation takes place, and thus the areas most difficult to repair and in need of most frequent repair, for instance the region of the trunions, are suitably coated. By the method disclosed, the operator can adjust the vertical height of a lance and determine at which height the particular nozzle is positioned for spraying in the areas intended. Additionally, since the oscillation is predetermined by the operation of the motor units, adjustment of the motor units permits accurate spraying in the regions intended. In this fashion, the intended areas are repaired automatically, at considerate time savings, without the manual operation of the operator, who must depend on sight and experience when spraying into a vessel which is lying on its side as contemplated in the prior art. In FIGS. 10, 11, 12 and **12*a*** various configurations of nozzles for discharging slurry in repair of vessels are disclosed in purely elevational views. In previous figures these have been shown and described in detail with the various parts identified by reference characters. In these figures however the parts will be merely described by name.

In FIG. 10 the nozzle is capped at one end and a nozzle extension is provided at the other end of the lateral outlet.

Figure 12A:
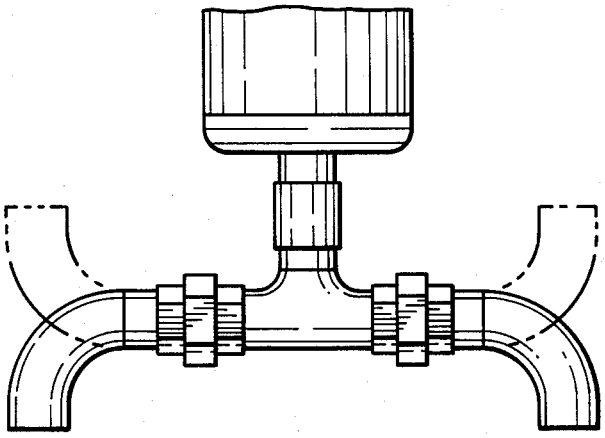

In FIG. 11, the nozzle design is for a particular local operation as may be the case of repairing or coating a spot on the bottom of the vessel. FIGS. 12 and **12*a* also are for specific applications and indicate the versatility of the arrangements and design with attachments of the parts being either by welding or by the use of threaded connections or other. In the case of the arrangements shown in FIG. 12 and 12*a*** threaded connectors of conventional pipe connector design may be utilized.

In FIGS. 13 and 14 another motor means 34 is disclosed. In this modification the motor means is seated upon the type of lance disclosed in FIGS. 2–4 which include the top adapter 25.

Also all of the motor means herein disclosed may be utilized with either of the lances and will provide for the necessary reciprocation and oscillation. In the modification shown in FIGS. 13, 14 and 15 a vertical plate support 115 has mounted thereon a gear driven unit 116, the plate 115 being supported on one end of the horizontal plate 32. Gear drive unit 116 is operated by means of an electric motor 117. A shaft 118 from gear drive 116 rotates an arm 119 which is pivotally connected to a link 120 by means of a pivot assembly 121. The end of the link 120 is provided with a pivotal connection 122 to an arm 123 which in turn is connected to the collar 83' for rotating the extension 81 of the slurry pipe. As best shown in FIG. 14 in phantom, the arm 123 is moved in oscillatory fashion, thus imparting similar oscillation to the slurry pipe as provided by the other motors. Changes in the length of the link 120 of course will change the swinging movement and thus adjustment is easily achieved. The degree of oscillatory movement is also determined by the area sought to be covered, this in turn determined by the repair required in the particular furnace lining.

FIGS. 15, 16 and 17 also disclose another motor unit designated as 35. The motor unit 35 is supported on the type of lance shown in FIGS. 7, 8 and 9 and is disposed between the vertical lifting bails of the sling assembly. In this modification, the flat plate 159 supports a cylindrical switch housing 130 which is connected by means of cap screws 131 to the plate 159. The top plate 132 is connected to the housing 130 and supports a rotary actuator housing 133. Cap screws 132' connect the actuator housing 133 to the plate 132.

As best shown in FIG. 15 the slurry extension 44 has connected thereto within the housing 130 a hub 134 which supports vertically spaced cam plates 135 and 136. Each of the plates include cam surfaces 135'. Thus, these plates are supported for rotation with the pipe 44 and the slurry pipe 43. An upper adjusting ring 137 is suitably supported for rotation about the outer peripheral surface of the switch housing 130. The adjusting ring 137 has connected thereto for movement therewith a switch 138 having a switch plunger 142. The switch plunger 142 is adapted to be actuated by means of its engagement with the curved cam surface 135'. Another adjusting ring 139 carries a switch 140, shown in FIG. 17, which also is provided with a similar plunger 142. Set screws 141 on each of the rings 137 and 139 may be tightened to lock the rotation of the rings in the desired position, affecting the degree of travel of oscillation of the slurry pipe.

During the operation, the adjusting rings are rotated, which in turn rotates each of the switches and thereby positioning the plungers 142 at a certain point on the cam surfaces 135' of each of the discs 135 and 136. Thus, the degree of oscillation of the slurry pipe can be determined by the setting of the particular switches. The rotary actuator housing 133 contains suitable piston mechanisms which provide for outward movement of the adjustable plunger means 143, disclosed in FIG. 17, into the position shown in phantom. Thus the bar 144 is moved outwardly and inwardly, as indicated, by hydraulic or other fluid pressure regulated by the switches 138 and 140 within the piston mechanisms in the rotary actuating housing 133. The vertical arm 145 which is connected to the bar 144 is in turn connected to a bracket 146 which supports a rack 147. Thus, the inward and outward movement of the rack 147 in response to the movement of the barr 144 provides for the reciprocation of the rack 147, which in turn rotates the pinion 148 thereby rotating the slurry pipe extension 81 and the slurry pipe 43. The reciprocation of the rack 147 thereby provides for the oscillation which is also achieved by the previous mechanisms disclosed.

The invention contemplates that the types of lances herein disclosed may be utilized for repairing all types of ladles or vessels wherein the lining has deteriorated or to provide an initial refractory or other material lining or coating. The various nozzle configurations also provide for specific application. Also while the supporting means disclosed provides for vertical adjustment, the improved lance designs disclosed can be positioned in any other manner, such as diagonally or horizontally.

In the present repair operation, the type of refractory or other material which may be employed is not pertinent to the invention since as long as the material may be distributed in slurry form, and is compatable with the coatings to be repaired, or to be initially placed it may be successfully employed. Various other types of oscillatory mechanisms may be utilized, the primary purpose of the oscillation being to permit the complete and effective coverage of the repaired portions or desired areas, and permitting the proper adjustments so that the degree of coverage can be varied for the particular purpose intended.

What is claimed is:

1. In a steel-making apparatus combination comprising a vessel having an upper open mouth, an outer steel shell, an inner lining providing a hearth portion, and trunnion means on said vessel adapted to support the same for pivotal movement from a vertical operating position to a tilted discharge position, the improvement comprising, a lining repair lance including, a central slurry pipe, a discharge nozzle connected to a lower end of said slurry pipe including an opening for discharging slurry material horizontally while said vessel is disposed in said vertical operating position, first inner, second intermediate, and third outer pipes concentric with said slurry pipe and relatively horizontally spaced to provide vertically extending inner and outer water passages, said first inner pipe being spaced from said slurry pipe to provide an elongated swivel support chamber, a top adapter assembly supporting said first, second and third pipes, means supporting said slurry pipe relative to said first, second and third pipes for relative rotating movement, conduit means connected to said slurry pipe including tubular swiveling means for directing pressurized slurry materials to said slurry pipe.

movable support means connected to said repair lance for moving the same relative to said mouth within said vessel for discharging slurry material against the inner lining of said vessel, and means associated with said top adapter assembly for rotating said discharge nozzle into selective areas within said vessel.

2. The invention in accordance with claim 1, said rotating means including oscillating means to provide an oscillating discharge of slurry through said nozzle.

3. The invention in accordance with claim 1, said top adapter assembly including a first horizontal flange connected to said first inner pipe, a third horizontal flange connected to said third outer pipe, a bushing means including a second horizontal flange supported between said third outer and first inner pipes, a horizontal plate having a central opening, means connecting said flanges and plate in assembly, and bearing means supported in said opening of said plate for supporting one end of said slurry pipe for rotating movement within said swivel support chamber.

4. The invention in accordance with claim 3, including second bearing means supported in a lower portion of said swivel support chamber for supporting the other end of said slurry pipe.

5. The invention in accordance with claim 4, said second bearing means comprising a spherical bearing.

6. The invention in accordance with claim 5, one portion of said spherical bearing means being supported on said first inner pipe, and another portion of said spherical bearing being supported on said slurry pipe.

7. The invention in accordance with claim 3, said first inner pipe including an upper first pipe section connected to said first flange, and said first inner pipe including a second pipe section connected to said first pipe section by means of a telescoping sleeve slidingly disposed between said bushing means and said first inner pipe section.

8. The invention in accordance with claim 3, said third outer pipe having upper and lower vertical pipe sections, a fourth horizontal disconnect flange on said upper section, and a fifth upper horizontal disconnect flange on said second inner pipe, and means connecting said fourth and fifth flange in assembly.

9. The invention in accordance with claim 1, said slurry pipe including a first upper section, and a second lower section, said first section being connected to said conduit means through said tubular swiveling means, said rotating means including upper bearing means supporting said first section adjacent the upper end of said swivel support chambers, and lower bearing means supporting said second section adjacent a lower end of said swivel support chamber.

10. The invention in accordance with claim 9, said rotating means comprising a motor, including means for oscillating said slurry pipe.

11. The invention in accordance with claim 1, said rotating means including a motor supported on said top adapter assembly of said lance, and means on said motor interconnecting the same and said slurry pipe for oscillating said slurry pipe.

12. The invention in accordance with claim 11, said motor comprising:

a rotating power driven shaft, a first arm connected to said shaft to rotate therewith, a link pivotally connected to said first arm, a second arm connected to said slurry pipe to rotate the same, and means pivotally connecting said first link and said second arm.

13. The invention in accordance with claim 11, said motor comprising:

a fluid extensible device including a cylinder and piston arrangement, a piston rod connected to said piston, fluid pressure means connected to said cylinder for reciprocating said piston and rod, an arm rigidly connected to said slurry pipe, and means pivotally connecting said arm to said piston rod.

14. The invention in accordance with claim 11, including electrical switching means on said motor for oscillating said slurry pipe.

15. The invention in accordance with claim 11, said interconnecting means on said motor, including a rack reciprocally positioned and a pinion rotated by said rack, and pinion being connected to said slurry pipe for rotating the same in oscillating motion.

16. The invention in accordance with claim 15, including switching means on said motor adapted to actuate the same for reciprocating said rack.

17. A slurry lance for spraying a slurry onto the inner refractory lining of a basic oxygen furance vessel for repairing said inner lining, said lance comprising:

a slurry pipe having an upper end portion having a swivel connection for being rotatably connected to a slurry supply conduit and a lower end portion having a slurry spraying nozzle means;

a lance cooling assembly having;

a first inner pipe concentric with and radially outwardly spaced from said slurry pipe;

a second intermediate pipe concentric with and radially outwardly spaced from said first inner pipe for forming a first fluid flow passage between said first and said second pipes;

a third outer pipe concentric with and radially outwardly spaced from said second intermediate pipe for forming a second fluid flow passage between said second and said third pipes, said first and second fluid flow passages being in fluid flow communication for enabling a cooling fluid to flow through said first passage into said second passage; and, an adaptor assembly having a first bearing means adjacent an upper terminal end portion of said first inner pipe for rotatably supporting said slurry pipe in a fixed longitudinal position with respect to said cooling assembly, said adaptor assembly having an annular plate and said first inner pipe of said cooling assembly having an upper terminal end portion sealingly and longitudinally slidably engaged with said annular plate of said adaptor assembly whereby said first inner pipe can expand and contract longitudinally with respect to said annular plate of said adaptor assembly in response to temperature changes to relieve thermally induced stresses in said lance.

18. The invention defined in claim 17 together with a second bearing means adjacent said lower end portion of said slurry pipe for rotatably connecting said slurry pipe to said first inner pipe.

19. The invention as defined in claim 17 together with annular bushing means affixed to an interior portion of said third outer pipe and sealingly and longitudinally slidably engaged with an end portion of said second intermediate pipe whereby said second intermediate pipe can expand and contact longitudinally with respect to said bushing in response to temperature changes to relieve thermally induced stresses in said lance.

20. The invention as defined in claim 19 together with flange disconnect means sealingly engaged with an upper end portion of said second intermediate pipe and a longitudinally intermediate portion of said third outer pipe for enabling said second intermediate pipe and a portion of said third outer pipe to be substantially slidably disassembled from said first inner pipe and said slurry pipe for repairing said lance.

21. The invention as defined in claim 18 together with a first disconnection means in said slurry pipe between said first bearing means and said second bearing means for facilitating repair of said slurry pipe.

22. The invention as defined in claim 21 in which said first disconnection means is a threaded coupler.

23. The invention as defined in claim 18 together with a second disconnection means in said slurry pipe between said second bearing means and said nozzle for facilitating replacement of said nozzle.

24. The invention as defined in claim 17 together with force means supportedly engaged with said cooling assembly and said force means being operatively connected to said slurry pipe for causing said slurry pipe to rotate with respect to said cooling assembly.

25. A lance for spraying slurry on the inner lining of a basic oxygen furnace vessel to repair said lining, said lance comprising, in combination:

a slurry pipe having a first end portion and a second end portion, said first end portion having swivel means for placing said slurry pipe in fluid flow communication with a slurry supply conduit, said second end portion having removable nozzle means for spraying slurry from said slurry pipe;

a cooling assembly surrounding, concentric with and radially outwardly spaced from said slurry pipe, said cooling assembly having a first end portion and a second end portion;

bearing means for maintaining said slurry pipe in fixed longitudinal relationship with said cooling assembly and for enabling said slurry pipe to rotate with respect to said cooling assembly;

cooling assembly disconnect flange means positioned longitudinally between said first end portion and said second end portion of said cooling assembly, said flange means serving to define an inlet passage into said cooling assembly and an outlet passage out of said cooling assembly; and lance support means supportingly engaged with said cooling assembly adjacent said first end of said cooling assembly for moving said lance into and out of a charging opening of a basic oxygen furnace vessel, said vessel being in an operative position and said lance being movable vertically with respect to said vessel.

* * * * *